US009915918B2

(12) United States Patent
Nanai et al.

(10) Patent No.: US 9,915,918 B2
(45) Date of Patent: Mar. 13, 2018

(54) IMAGE FORMING APPARATUS WITH FIXING DEVICE DETACHABLY MOUNTED THERETO

(71) Applicant: CANON KABUSHIKI KAISHA, Tokyo (JP)

(72) Inventors: Ryosuke Nanai, Tokyo (JP); Tetsuhiro Yoshimoto, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/251,296

(22) Filed: Aug. 30, 2016

(65) Prior Publication Data

US 2017/0068212 A1 Mar. 9, 2017

(30) Foreign Application Priority Data

Sep. 7, 2015 (JP) ..... 2015-176093

(51) Int. Cl.

| | |
|---|---|
| ***G03G 21/18*** | (2006.01) |
| ***G03G 21/16*** | (2006.01) |
| ***G03G 15/20*** | (2006.01) |
| ***G03G 15/00*** | (2006.01) |

(52) U.S. Cl.

CPC ..... *G03G 21/1889* (2013.01); *G03G 15/2078* (2013.01); *G03G 15/5004* (2013.01); *G03G 21/1685* (2013.01); *G03G 21/1892* (2013.01); *G03G 2221/1639* (2013.01); *G03G 2221/1823* (2013.01); *G03G 2221/1838* (2013.01); *G03G 2221/1892* (2013.01)

(58) Field of Classification Search

CPC ..... G03G 21/1685; G03G 21/1892

See application file for complete search history.

(56) References Cited

U.S. PATENT DOCUMENTS

2008/0240745 A1* 10/2008 Hibino ..... G03G 15/553 399/24
2010/0172668 A1* 7/2010 Yoshimoto ..... G03G 15/2039 399/69
2013/0322907 A1 12/2013 Namiki

FOREIGN PATENT DOCUMENTS

JP 2004-354406 A 12/2004
JP 2011-197372 A 10/2011

OTHER PUBLICATIONS

JP_2004354406_A_T MachineTranslation, Japan, 2004, Tananoka et al.*

* cited by examiner

*Primary Examiner* — Clayton E Laballe
*Assistant Examiner* — Victor Verbitsky
(74) *Attorney, Agent, or Firm* — Fitzpatrick, Cella, Harper & Scinto

(57) ABSTRACT

An image forming apparatus comprises a fixing device comprising a heater for heating a sheet on which an image is formed and a non-volatile memory in which characteristic information of the heater is stored. The fixing device is replaceable. In a case where the fixing device is replaced, the image forming apparatus starts to supply power to the heater before completing to read the characteristic information from the fixing device replaced. Due to this, the image forming apparatus can promptly heat the heater of the fixing device than before.

7 Claims, 8 Drawing Sheets

IMAGE FORMING APPARATUS WITH FIXING DEVICE DETACHABLY MOUNTED THERETO

BACKGROUND OF THE INVENTION

Field of the Invention

The present disclosure relates to an image forming apparatus for forming images on a sheet, such as a printer, a copying machine, a multifunction peripheral and the like.

Description of the Related Art

An electrophotographic image forming apparatus performs image formation by forming a toner image on a photoreceptor and transferring the toner image to a sheet. The image forming apparatus is provided with a fixing device for fixing the toner image on the sheet by heating and pressurizing the toner image. To heat the toner image, the fixing device comprises a resistance heater as a heat source. Due to variation in resistance value, the resistance heaters have individual differences in heating value. In a conventional image forming apparatus, the resistance value of the resistance heater is detected by feeding a small current to the fixing device before starting to heat the resistance heater. Then, heating of the resistance heater is started with power according to a detection result. Japanese Patent Application Laid-open No. 2011-197372 discloses a fixing device including a non-volatile memory which stores characteristic information relating to the fixing device such as the resistance value of the resistance heater. The image forming unit obtains the characteristic information from the non-volatile memory before starting to heat the resistance heater. Then, according to the characteristic information obtained, the resistance heater of the fixing device is heated.

In a case where the fixing device is heated after obtaining the characteristic information stored in the fixing device, it is not necessary to detect the resistance value of the resistance heater before starting to heat the resistance heater. In terms of cost, inexpensive non-volatile memory, transfer rate of which is about 100 kbps, is used as the non-volatile memory provided in the fixing device. Thereby, in a case where heating of the resistance heater is started after completing reading of the characteristic information, by the time heating of the resistance heater is started, standby time is caused, which hampers rapid heating of the fixing device. Thereby, an image forming apparatus capable of heating the heater of the fixing device comprising a storage unit which stores the characteristic information more rapidly than before is desired.

SUMMARY OF THE INVENTION

According to the present disclosure, there is provided an image forming apparatus to which a fixing device, comprising a heater and a memory for storing information relating to the heater, is detachably mounted, the image forming apparatus comprising: a storage unit configured to store the information relating to the heater obtained from the fixing device; an image forming unit configured to form an image on a sheet; and a controller for controlling power to be supplied to the heater based on the information stored in the storage unit to cause the fixing device to fix the image on the sheet, wherein the controller detects replacement of the fixing device, wherein, in a case where replacement of the fixing device is detected, the controller reads information stored in the memory of the fixing device replaced to update the information stored in the storage unit, and wherein, in a case where replacement of the fixing device is detected, the controller starts to supply power to the heater before completing to read the information from the memory of the fixing device replaced.

Further features of the present invention will become apparent from the following description of exemplary embodiments (with reference to the attached drawings).

DESCRIPTION OF THE EMBODIMENTS

In the following, embodiments are described in detail with reference to the accompanying drawings.

Figure 1:
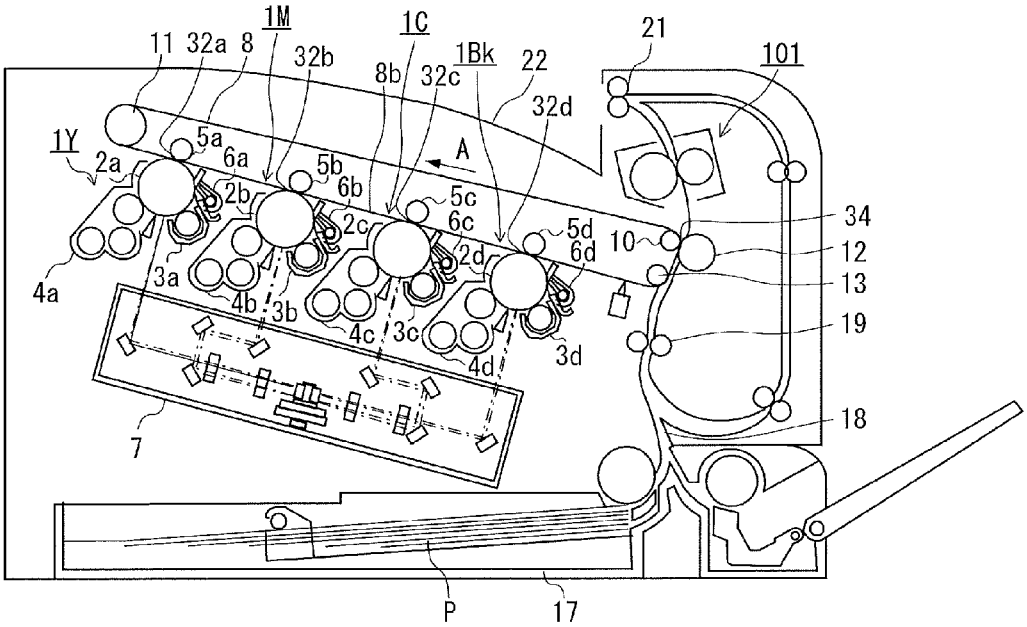
FIG. 1 is a schematic configuration diagram of an image forming apparatus.

FIG. 1 is a schematic configuration diagram of a tandem type color image forming apparatus. The image forming apparatus is provided with four image forming units including an image forming unit 1Y for forming an image of yellow, an image forming unit 1M for forming an image of magenta, an image forming unit 1C for forming an image of cyan, and an image forming unit 1Bk for forming an image of black. These four image forming units, 1Y, 1M, 1C, and 1Bk are arranged in a row at regular intervals.

A description is provided with regard to a configuration of the image forming unit 1Y. The configuration of the image forming units 1M, 1C, and 1Bk is the same as that of the image forming unit 1Y so that the description is omitted. The image forming unit 1Y comprises a drum type electrophotographic photoreceptor (hereinafter referred to as "photosensitive drum") 2*a* as an image carrier. The image unit 1Y comprises a primary charger 3*a*, a developing unit 4*a*, a transfer roller 5*a*, and a drum cleaner 6*a*, which are provided around the photosensitive drum 2*a*. The image forming unit 1Y is an example of a cartridge member in which the photosensitive drum 2*a*, the primary charger 3*a*, the developing unit 4*a*, the transfer roller 5*a*, and the drum cleaner 6*a* are integrated, and which is attachable/detachable to/from the image forming apparatus.

The photosensitive drum 2*a* is a negatively charged OPC photoreceptor, which has a photoconductive layer on an aluminum drum base. The photosensitive drum 2*a* is rotationally driven at predetermined processing speed by a driving device (not shown). The primary charger 3*a* uniformly charges a surface of the photosensitive drum 2*a* by a charging bias to a predetermined negative potential.

A laser exposure unit 7 is provided below the primary charger 3*a* and the developing unit 4*a*. The laser exposure unit 7 is comprised of a light emitting unit, which emits light corresponding to image data, a polygon lens, a reflection mirror, and the like. The laser exposure unit 7 forms an electrostatic latent image corresponding to the image data of each color on a surface of each photosensitive drum 2*a*, 2*b*, 2*c*, and 2*d* by performing exposure on each photosensitive drum 2*a*, 2*b*, 2*c*, and 2*d*. The developing units 4*a*, 4*b*, 4*c*, and 4*d* respectively store toner of yellow, magenta, cyan, and black. By adhering the toner of each color to the electrostatic latent image formed on each photosensitive drum 2*a*, 2*b*, 2*c*, and 2*d*, the toner image is developed (visualized).

The transfer roller 5*a* is arranged so that it is brought into contact with the photosensitive drum 2*a* through an intermediate transfer belt 8 in a primary transfer unit 32*a*. The toner images formed on the photosensitive drums 2*a*, 2*b*, 2*c*, and 2*d* are transferred to the intermediate transfer belt 8 so as to sequentially overlap each other. The drum cleaners 6*a*, 6*b*, 6*c*, and 6*d*, consisting of a cleaning blade and the like, scrape toner remaining on the photosensitive drums 2*a*, 2*b*, 2*c*, and 2*d* after the first transfer for cleaning.

The intermediate transfer belt 8 is arranged on an upper surface of the photosensitive drums 2*a*, 2*b*, 2*c*, and 2*d*. Further, the intermediate transfer belt 8 is stretched by a secondary transfer opposed roller 10, a tension roller 11, and an intermediate transfer drive roller 13. The intermediate transfer belt 8 is made of polycarbonate and dielectric resin such as polyethylene terephthalate resin film, polyvinyl fluoride vinylidene resin film. The secondary transfer opposed roller 10 is arranged so that it is brought into contact with the secondary transfer roller 12 through the intermediate transfer belt 8 in a secondary transfer unit 34. The toner image transferred to the intermediate transfer belt 8 is transferred to a sheet P conveyed from a sheet feeding unit 17 in the secondary transfer unit 34.

The sheet P is stored in the sheet feeding unit 17 arranged below the image forming units 1Y, 1M, 1C and 1Bk. The sheet P is conveyed to the secondary transfer unit 34 by a conveying roller 19 via a conveying path 18. The toner image is transferred to the sheet P in the secondary transfer unit 34. Thereafter, the toner image is fixed on the sheet P by a fixing device 101. By heating and pressurizing the sheet P, the fixing device 101 fixes the toner image on the sheet P. In this manner, the image is formed on the sheet P. Then, the sheet P is delivered from the image forming apparatus by a delivery roller 21.

Figure 2A:
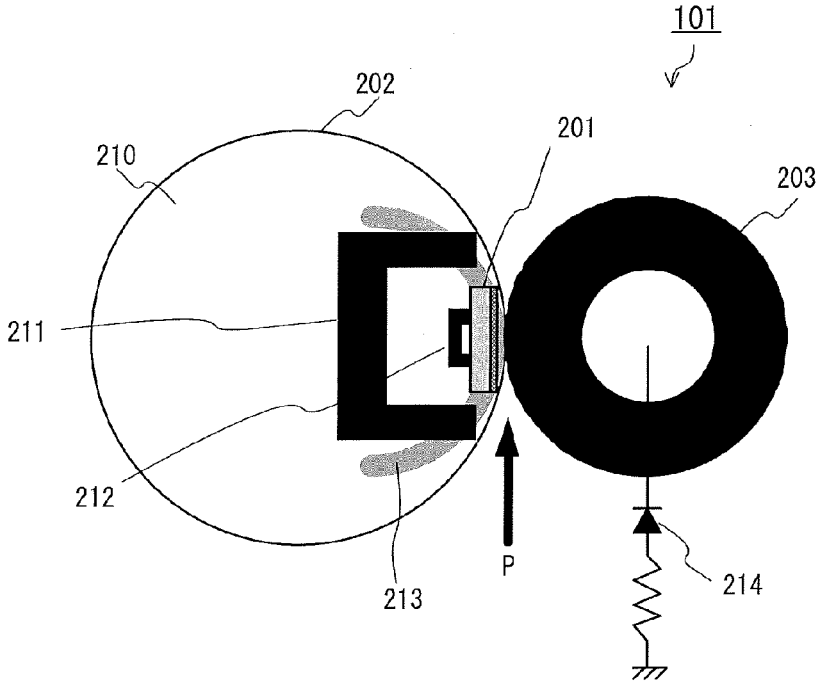
FIGS. 2A, 2B, and 2C are explanatory diagrams of the fixing device.
Figure 2B:
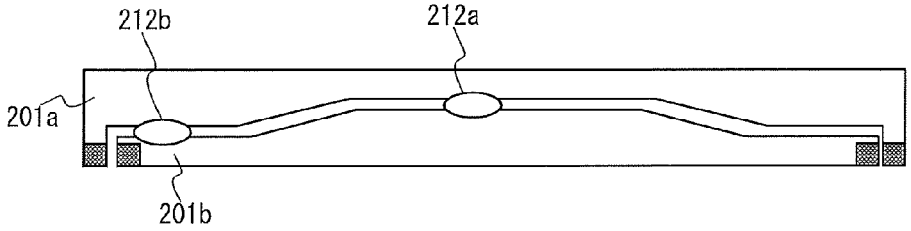
Figure 2C:
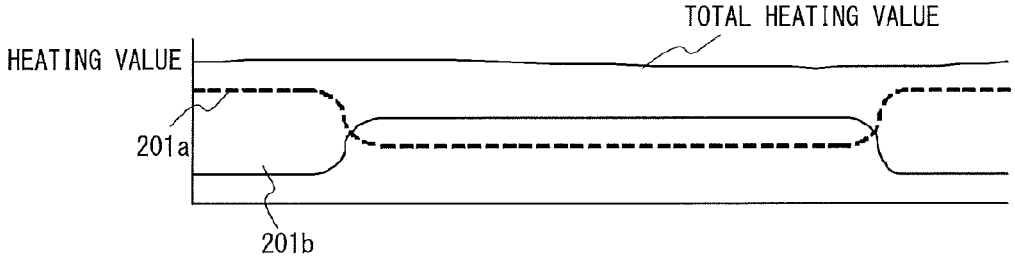

FIGS. 2A, 2B, and 2C are explanatory diagrams of the fixing device 101.

FIG. 2A shows a configuration of the fixing device 101. The fixing device 101 comprises a heating member 210 for heating the sheet P and a pressurizing roller 203 for pressurizing the sheet P interposed between the heating member 210 and the pressurizing roller 203. The heating member 210 comprises a heater 201, a fixing film 202, a sheet metal 211, a temperature detection unit 212, and a holder 213. The heater 201 and the temperature detection unit 212 are mounted to the holder 213.

The pressurizing roller 203 is connected to a self-bias section 214. With the self-bias section 214, the pressurizing roller 203 removes negative charges from the sheet P. The pressurizing roller 203 rotates while being energized to the heating member 210 side. The pressurizing roller 203, hardness of which is about 60 degrees, frictionally drives the fixing film 202.

The heater 201 is a resistance heater comprising a ceramic substrate on which heating patterns 201*a* and 201*b* as shown in FIG. 2B are printed. For example, the heating patterns 201*a* and 201*b* of the heater 201 are formed by a heating member having high responsiveness such as that allows temperature rise of about 50° C. in one second. FIG. 2C shows heat generation characteristics of the heater 201. At a center part of the heater 201, heating value by the heating pattern 201*b* is high. At an end part of the heater 201, the heating value by the heating pattern 201*a* is high. The heating patterns 201*a* and 201*b* are formed such that the heating value of the heater 201 is entirely constant.

The fixing film 202 is a film-like member, the base material of which is metal. A rubber layer of about 300 μm is formed on a surface of the fixing film 202. Further, fluorine surface treatment is applied to the fixing film 202. The fixing film 202 includes the heater 201, the temperature detection unit 212, the holder 213, and the sheet metal 211. The fixing film 202, with extremely low heat capacity, is configured to transfer the heat of the heater 201 through a nip portion which contacts the pressurizing roller 203.

The sheet metal 211 is a c-shaped member which energizes the fixing film 202 to the pressurizing roller 203 side. For example, the sheet metal 211 energizes the fixing film 202 with a force of 180 N.

The temperature detection unit 211 is a thermistor, and may be, for example, a sensor for detecting the temperature of the heater 201. As shown in FIG. 2B, the temperature detection unit 212 is arranged at the center part and the end part of the heater 201. A main temperature detection unit 212*a* arranged at the center part of the heater 201 detects the temperature for controlling the temperature of the heater 201. A sub temperature detection unit 212*b* arranged at the end part of the heater 201 detects, when small-sized sheet P and the like pass through the nip, the temperature of a part of the nip where the small-sized sheet P does not pass through. With the sub temperature detection unit 212*b*, it is possible to detect the temperature rise of the part of the nip where the sheet P does not pass through.

Figure 3:
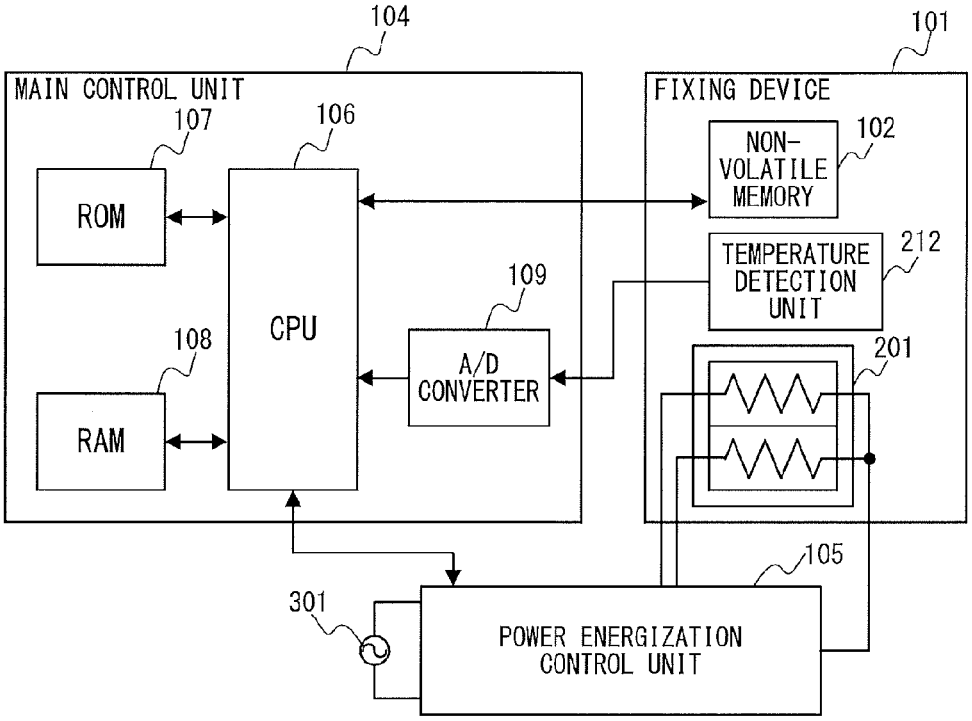
FIG. 3 is an explanatory diagram of a main control unit.

FIG. 3 is an explanatory diagram of a main control unit 104. The main control unit 104 is provided in the image forming apparatus. The main control unit 104 controls image forming processing performed on the sheet P by controlling operation of each unit in the image forming apparatus. In the present embodiment, among various functions of the main control unit 104, a function which performs temperature control of the fixing device 101 is described. Description with regard to the rest of the functions is omitted. To perform the temperature control of the fixing device 101, the main control unit 104 is connected to the fixing device 101 and a power energization control unit 105.

In addition to the heater 201 and the temperature detection unit 212, the fixing device 101 comprises a non-volatile memory 102. The non-volatile memory 102 stores the characteristic information representing the characteristic of the fixing device 101 required for controlling the fixing device 101. For example, the characteristic information includes resistance value or the temperature characteristic of the heater 201. Due to variation in the resistance value, the heater 201 has an individual difference in heating value. The characteristic information is the information to suppress the variation.

According to the characteristic information obtained from the fixing device 101 and the temperature of the heater 201 detected by the temperature detection unit 212, the main control unit 104 controls the power energization control unit 105 to perform power energization control of the heater 201. Through the power energization control, the heating value of the heater 201 is controlled so that the heater 201 generates heat at predetermined temperature. The main control unit 104 comprises a central processing unit (CPU) 106, a read only memory (ROM) 107, a random access memory (RAM) 108, and an A/D converter 109.

The CPU 106 performs various processing relating to the image formation by reading a computer program from the ROM 107 and executing the computer program using the RAM 108 as a work area. In the present embodiment, by performing power energization control of the heater 201 as mentioned, the CPU 106 adjusts the temperature of the heater 201. The CPU 106 obtains the characteristic information from the non-volatile memory 102 through serial communication. Based on the characteristic information, the CPU 106 updates a power energization ratio setting value that is used by the power energization control unit 105 in supplying power to the fixing device 101. The CPU 106 transmits a power energization control signal, including the updated power energization ratio setting value, to the power energization control unit 105. The power energization control unit 105 adjusts the heating value of the heater 201 according to the power energization control signal. The power energization ratio setting value is a value stored in advance in the RAM 107 and the like.

The A/D converter 109 obtains the detection result of the temperature of the heater 201 detected by the temperature detection unit 212 of the fixing device 101. Then, the A/D converter 109 performs A/D conversion of the detection result obtained. The CPU 106 refers to a temperature conversion table showing a relationship between the detection result of the temperature detected by the temperature detection unit 212 and the temperature of the heater 201. Then, the CPU 106 confirms the temperature of the heater 201 from the detection result detected by the temperature detection unit 212 which is A/D converted. It is noted that the temperature conversion table is stored in advance in the ROM 107, the RAM 108, or the non-volatile memory 102.

Figure 4:
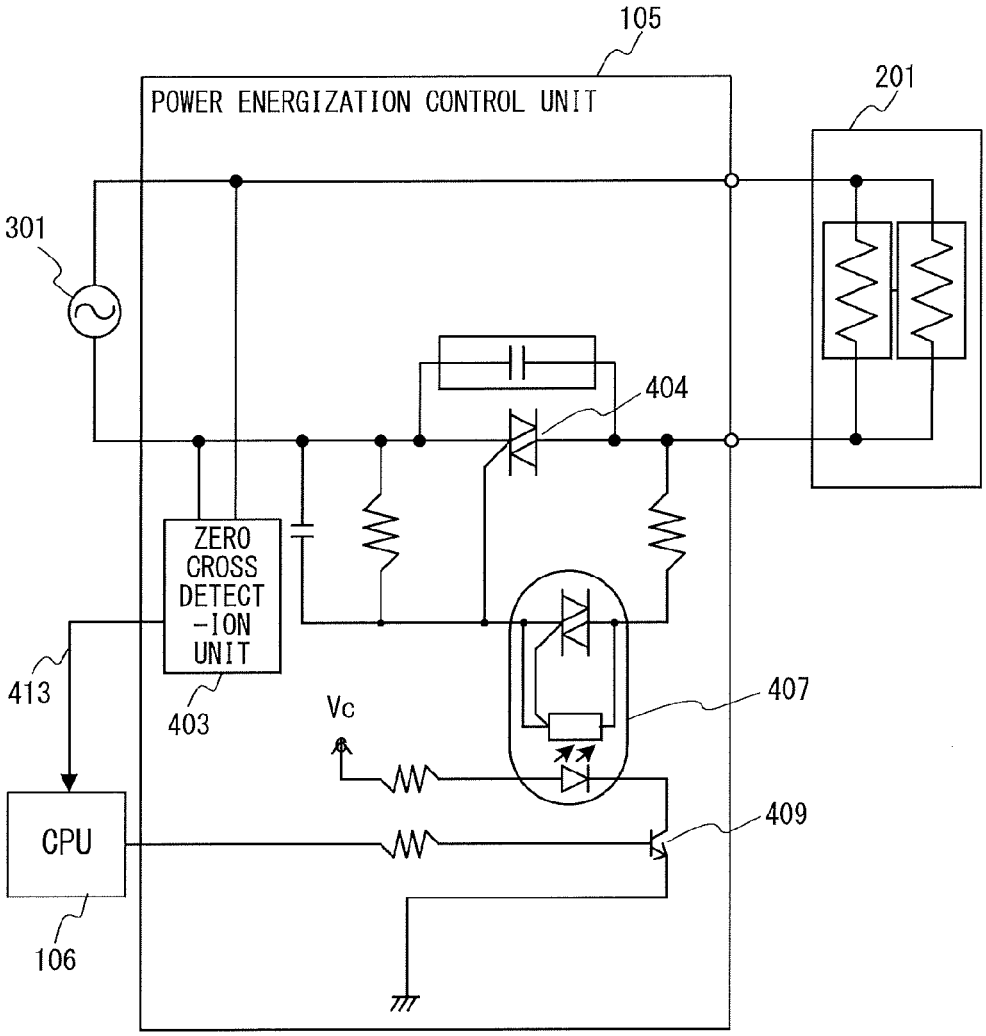
FIG. 4 is an explanatory diagram of a power energization control unit.

FIG. 4 is an explanatory diagram of the power energization control unit 105. The power energization control unit 105 comprises a zero cross detection unit 403, a photo triac coupler 407, a transistor 409, and a triac 404. According to the power energization control signal which is input from the CPU 106, the power energization control unit 105 supplies power which is supplied from a commercial power supply 301 to the heater 201.

The power energization control signal is input into the transistor 409. In a case where the power energization control signal instructs to supply power to the heater 201, the transistor 409 switches the triac 404 to a power energization state via the photo triac coupler 407. The triac 404 functions as a switch for supplying power from the commercial power supply 301 to the heater 201.

The zero cross detection unit 403 detects a zero cross point of AC voltage which is supplied from the commercial power supply 301. Then, the zero cross detection unit 403 inputs a zero cross signal 413, showing the detection result, into the CPU 106. To efficiently heat the heater 201 at desired temperature, based on the zero cross signal 413, the CPU 106 performs phase control of the power which is supplied to the heater 201.

Figure 5:
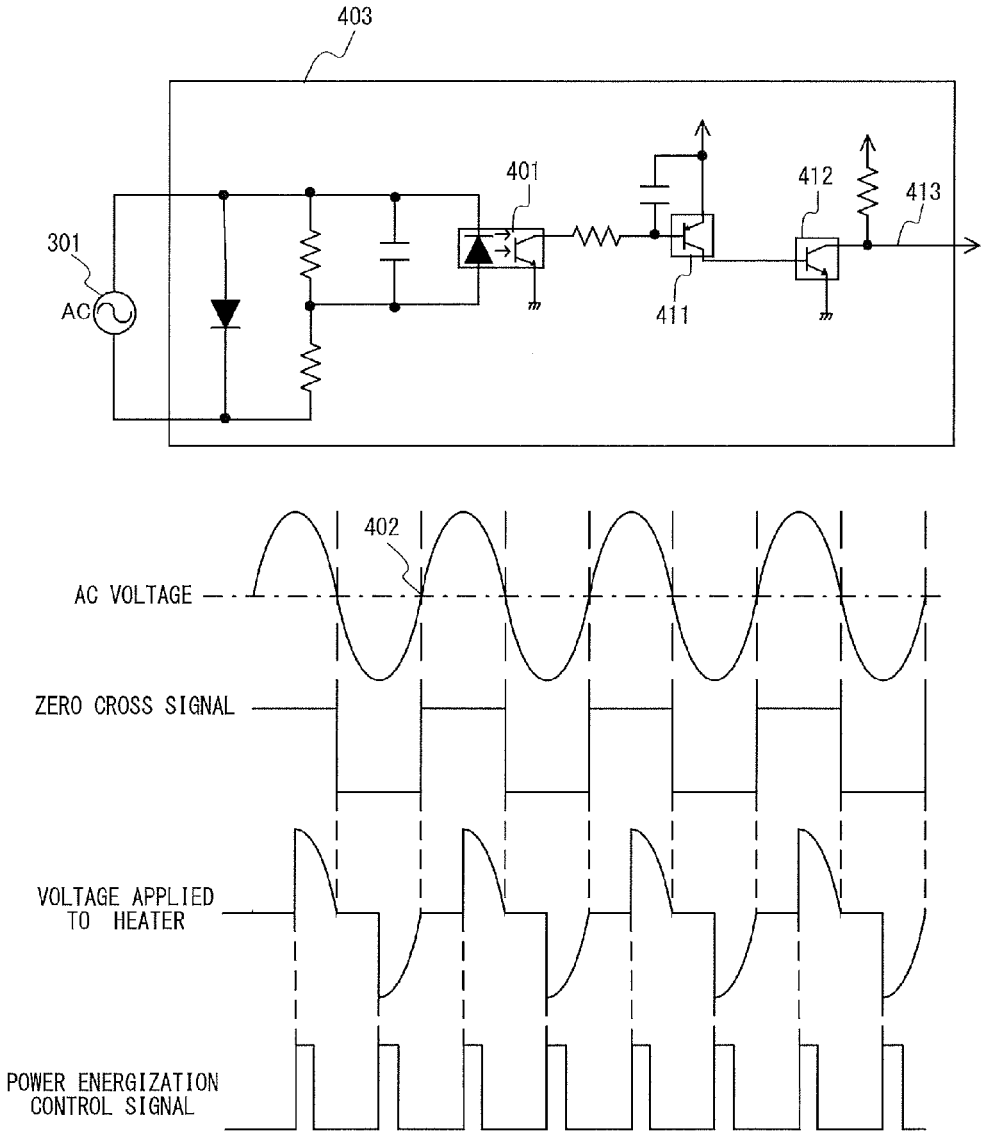
FIG. 5 is an explanatory diagram of a zero cross detection unit.

FIG. 5 is an explanatory diagram of the zero cross detection unit 403. The zero cross detection unit 403 comprises a photo coupler 401 and transistors 411 and 412. In a case where voltage is supplied from the commercial power supply 301 in a forward direction of a light emitting diode incorporated in the photo coupler 401, the zero-cross detection unit 403 outputs the zero cross signal 413 in a high state. In a case where voltage is supplied from the commercial power supply 301 in a reverse direction of the light emitting diode, the zero cross detection unit 403 outputs the zero cross signal 413 in a low state. A falling part where the state of the zero cross signal 413 switches from the high state to the low state is a zero cross point 402.

On the basis of the zero cross point 402, the CPU 106 performs the phase control of the power which is supplied to the heater 201 defining a high section or a low section of the zero cross signal 413 as one half-wave section. At a timing adapted for the power to be supplied in one half-wave, the CPU 106 outputs the power energization control signal to make the triac 404 conductive. The triac 404 turns to a non-conductive state at a timing of the zero cross point. To switch the triac 404 to be conductive/non-conductive in one half-wave cycle, the CPU 106 can control the power which is supplied to the heater 201 as a phase angle of the power to be supplied. Further, by adjusting a ratio of the high state and the low state of the power energization control signal with respect to the power required, the CPU 106 may control the power which is supplied to the heater 201.

Figure 6:
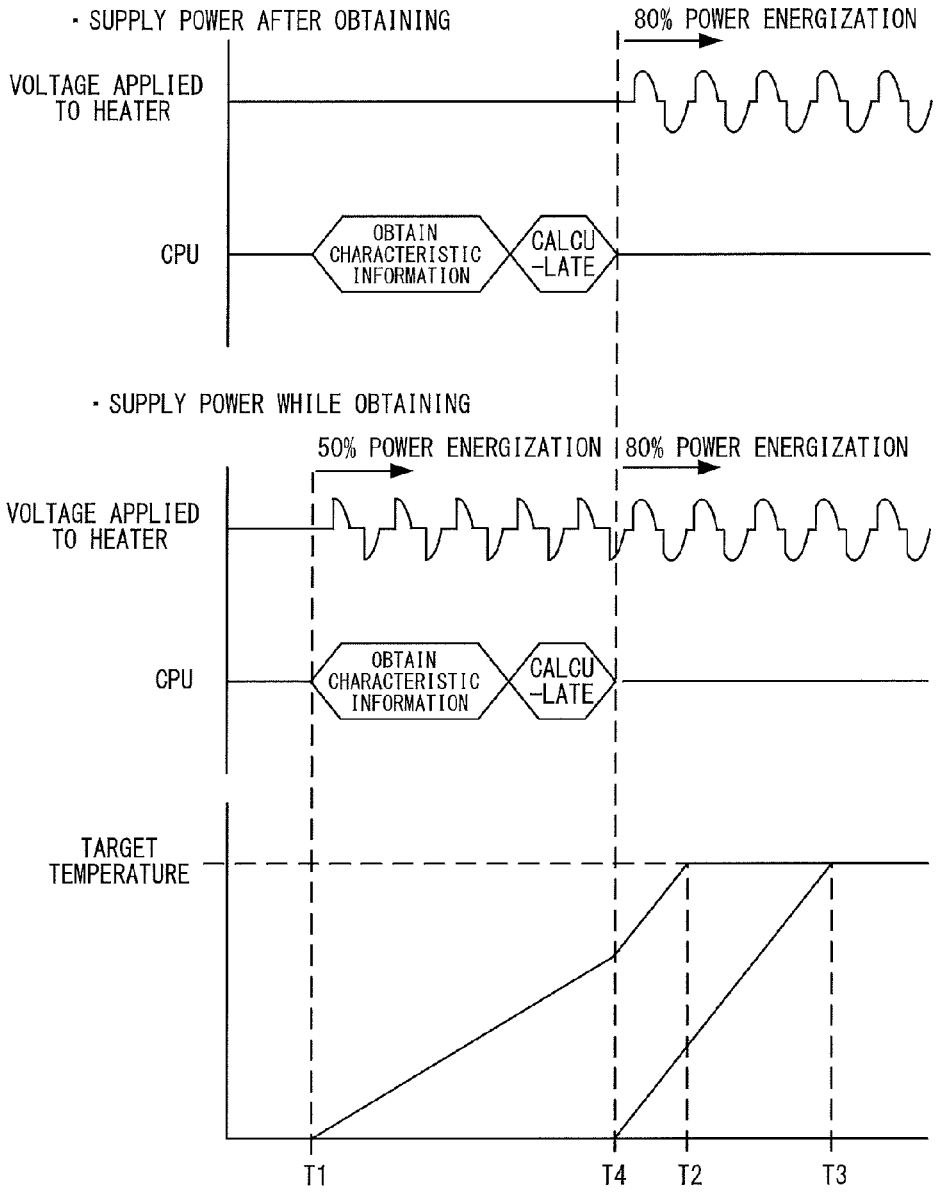
FIG. 6 is a timing chart when supplying power to a heater.

FIG. 6 is a timing chart when supplying power to the heater 201. As mentioned, when supplying power to the heater 201, in the present embodiment, the main control unit 104 obtains the characteristic information from the non-volatile memory 102 of the fixing device 101. Conventionally, the main control unit 104 obtains the characteristic information through the serial communication. Then, after completing the obtaining of the characteristic information, the main control unit 104 starts to supply power to the heater 201. In the present embodiment, the main control unit 104 supplies a minimum power capable of being supplied to the heater 201 while obtaining the characteristic information. For example, in the present embodiment, the minimum power is 50% of the power capable of being supplied in one half-wave.

The conventional main control unit 104 does not instruct the power energization control unit 105 to supply power to the heater 201 from a time T1, when the main control unit 104 starts to obtain the characteristic information, to a time T4, when the main control unit 104 completes the obtaining of the characteristic information. At the time T4, power supply to the heater 201 is started. At a time T3, the heater 201 reaches target temperature required to fix the toner image on the sheet P. From the time T1 at which the main control unit 104 starts the obtaining of the characteristic information, to the time T3, at which the heater 201 reaches the target temperature, a time (T3-T1) is required.

In the present embodiment, the main control unit 104 starts to obtain the characteristic information at the time T1. At the same time, the main control unit 104 supplies the minimum power capable of being supplied, by the commercial power source 301, to the heater 201. At a time T2, which is earlier than the time T3, the heater 201 reaches the target temperature. Thereby, from the time T1 at which the main control unit 104 starts the obtaining of the characteristic information to the time T2, at which the heater 201 reaches the target temperature, a time (T2-T1) is required. With this configuration, by starting to heat the heater 201 while obtaining the characteristic information, the main control unit 104 can make the heater 201 reach the target temperature in a shorter time than before. In particular, by shortening the time (T3-T1) by a time (T3-T2), the main control unit 104 can make the heater 201 reach the target temperature more quickly.

For example, as the serial communication when obtaining the characteristic information, the CPU 106 of the main control unit 104 performs I2C communication. The communication speed is 100 Kbit/s. A data amount of the characteristic information is 512 bits. In the I2C communication, the CPU 106 accesses 8-bit information at one time and about 0.8 milliseconds are required for reading. Because the data amount of the characteristic information is 512 bits, about 30 milliseconds are required for communication time. Further, the CPU 106 performs communication with other components of the image forming apparatus other than the fixing device 101. Thereby, considering standby time, the CPU 106 requires about 200 to 300 milliseconds for completing the obtaining of the characteristic information. Thereby, in the present embodiment, it is possible to start to heat the heater 201 about 200 to 300 milliseconds earlier than before.

In the following description, the power which is supplied to the heater 201 is defined as follows, for example. The resistance value of the heater 201 is 10Ω±7%, variation in AC voltage is 85 to 115 V, and input power while the resistance value of the heater 201 is not determined is 900 W. In a case where 100% power is supplied to the heater 201 in one-half wave, variation is caused in the power, i.e., the power varies from 844 to 1777 W. Thereby, while the resistance value of the heater 201 is not determined, i.e., while the characteristic information is being obtained, the CPU 106 supplies 50% power in one half-wave. It is noted that the CPU 106 may detect the AC voltage which is supplied, suppress the variation in the AC voltage, and supply the larger power while the characteristic information is being obtained.

Figure 7:
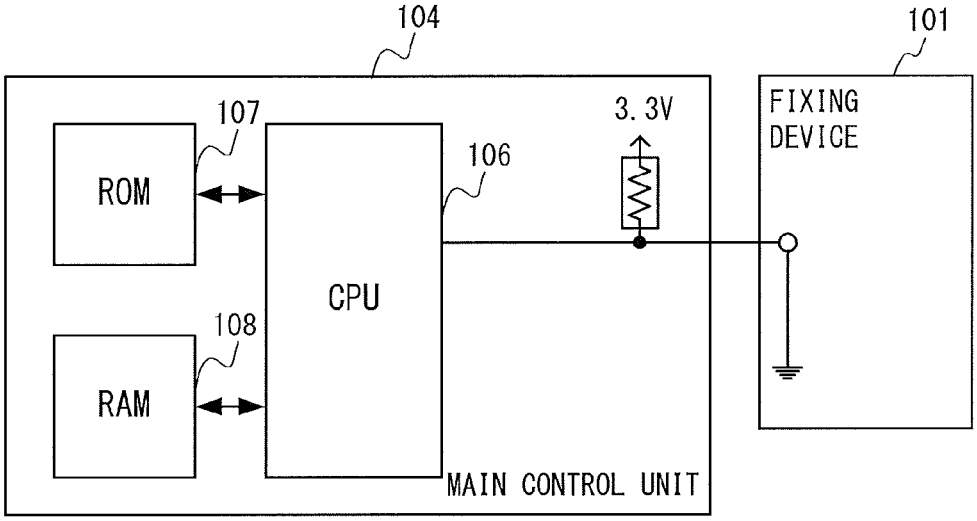
FIG. 7 is an explanatory diagram configured to detect attachment/detachment of the fixing device.

In a case in which the fixing device 101 can attach/detach from the image forming apparatus, the main control unit 104 is configured to detect attachment/detachment of the fixing device 101. That is, every time a new fixing device 101 is mounted to the image forming apparatus, the main control unit 104 is required to obtain the characteristic information of the new fixing device 101. FIG. 7 is an explanatory diagram of the configuration in which the main control unit 104 detects the attachment/detachment of the fixing device 101.

In a case where the fixing device 101 is mounted to the image forming apparatus, a mounting terminal for detecting a mounting state is connected to a ground in the fixing device 101. In this case, a low mounting signal is input into the mounting terminal of the CPU 106. In a case where the fixing device 101 is detached from the image forming apparatus, the mounting signal is pulled up by the power source in the fixing device 101 (3.3 V). In this case, a high mounting signal is input into the mounting terminal of the CPU 106. When detecting that the fixing device 101 is detached by the mounting signal while the power source is turned on, the CPU 106 turns an attachment/detachment detection flag, representing the mounting state of the fixing device, ON.

Further, other than the mounting signal, the CPU 106 may detect the mounting state of the fixing device 101 based on the detection result of the temperature detection unit 212. The CPU 106 obtains the detection result of the temperature of the heater 201 from the temperature detection unit 212 while the power source is turned on. The CPU 106 determines that the fixing device 101 is attached/detached and replaced by confirming that the temperature of the heater 201 is changed by a predetermined temperature or more in a predetermined time period while not being energized (i.e., supplied with power) by the heater 201.

Further, the CPU 106 may determine the occurrence of replacement of the fixing device 101 based on a comparison result obtained by, for example, reading a serial ID for identifying the fixing device 101 stored in the non-volatile memory 102 and comparing a serial ID stored in the RAM 108 with the serial ID read. In a case where the serial ID stored in the RAM 108 is identical to the serial ID read, the CPU 106 determines that the fixing device 101 has not been replaced. In a case where the serial ID stored in the RAM 108 is not identical to the serial ID read, the CPU 106 determines that the fixing device 101 has been replaced. In a case where the fixing device 101 has been replaced, the CPU 106 stores the serial ID and the characteristic information of the fixing device 101 in the RAM 108. Due to this process, the information stored in the RAM 108 is updated.

Figure 8:
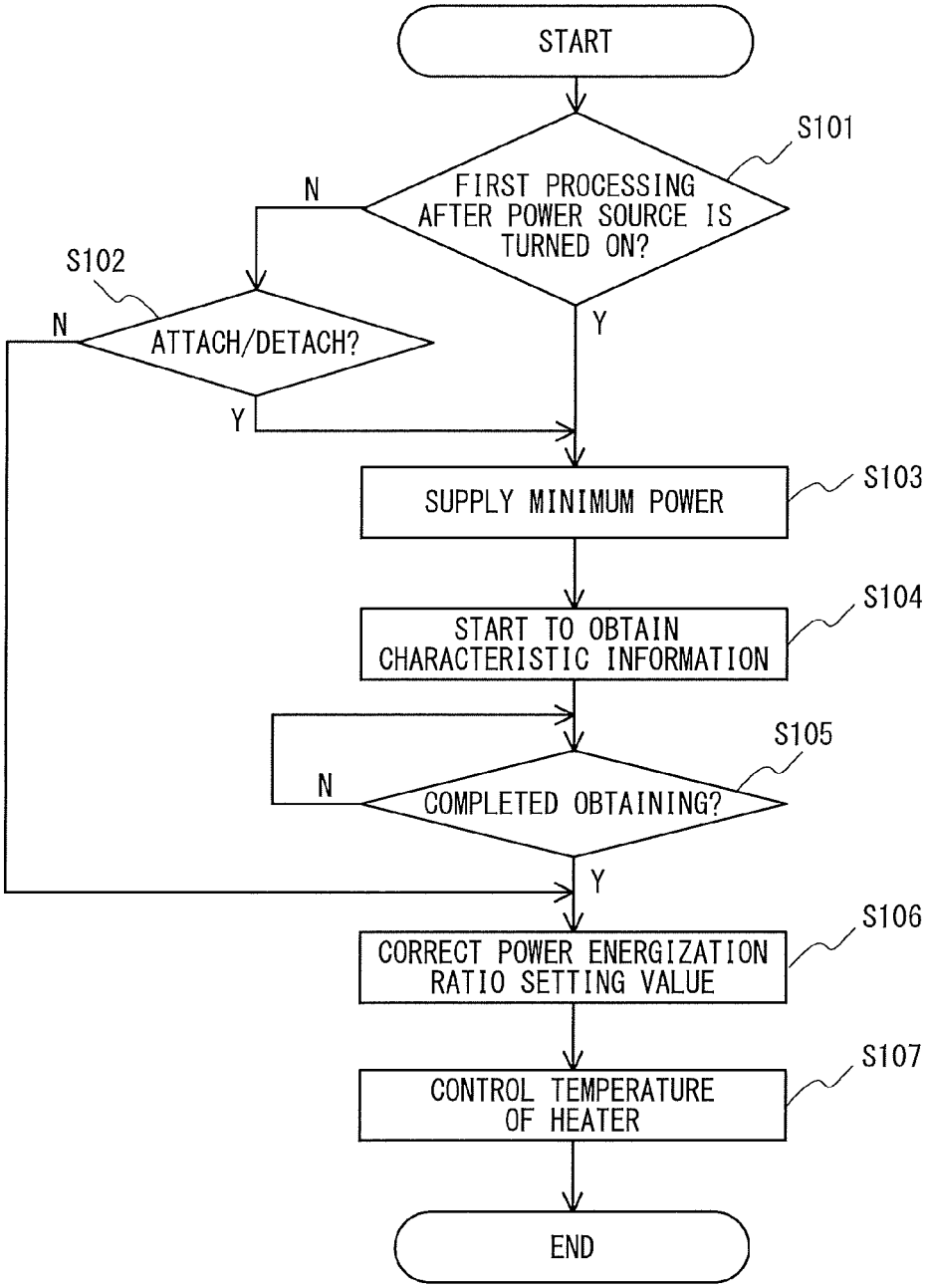
FIG. 8 is a flow chart showing temperature control processing.

FIG. 8 is a flowchart showing temperature control processing of the heater 201 performed by the image forming apparatus as mentioned above. The processing is performed when supplying power to the heater 201 to heat the heater 201, i.e., when forming images.

The main control unit 104 determines whether it is first processing after the power source is turned on or not (Step S101). The main control unit 104 stores, for example, a log of the processing performed by the image forming apparatus in the RAM 108. By confirming the log, the main control unit 104 determines whether it is the first processing after the power source is turned on or not. If it is determined that it is not the first processing after the power source is turned on (Step S101: N), the main control unit 104 determines whether attachment/detachment of the fixing device 101 to/from the image forming apparatus is performed or not (Step S102). The main control unit 104 confirms the attachment/detachment of the fixing device 101 by the attachment/detachment detection flag.

If it is determined that it is the first processing after the power source is turned on (Step S101: Y), or if the fixing device 101 is attached/detached (Step S102: Y), the main control unit 104 needs to newly obtain the characteristic information of the fixing device 101. Thereby, the main control unit 104 first supplies the minimum power to the heater 201 of the fixing device 101 (Step S103). The main control unit 104 transmits the power energization control signal to the power energization control unit 105. The power energization control signal is to supply the minimum power to the heater 201. The power energization control unit 105 performs power energization control according to the power energization control signal and starts to heat the heater 201.

After starting to supply the minimum power to the heater 201, the main control unit 104 starts to obtain the characteristic information of the fixing device 101 from the non-volatile memory 102 of the fixing device 101 (Step S104). When the main control unit 104 completes obtaining the characteristic information (Step S105: Y), the main control unit 104 updates the power energization ratio setting value according to the characteristic information (Step S106). For example, the main control unit 104 stores the characteristic information obtained in the RAM 108.

It is noted that if no attachment/detachment of the fixing device 101 is performed (Step S102: N), the main control unit 104 already obtains the characteristic information of the fixing device 101 mounted and stores the characteristic information in the RAM 108 through the previous processing. In this case, the main control unit 104 updates the power energization ratio setting value based on the characteristic information already obtained through the processing of Step S106.

The main control unit 104 supplies the power according to the updated power energization ratio setting value to the heater 201 of the fixing device 101 by the power energization control unit 105 (Step S107). The main control unit 104 transmits the power energization control signal to the power energization control unit 105. The power energization control signal is to supply the power updated according to the updated power energization ratio setting value to the heater 201. The power energization control unit 105 performs power energization control according to the power energization control signal and controls the temperature of the heater 201.

As mentioned, the image forming apparatus of the present embodiment starts to heat the heater 201 before completing the obtaining of the characteristic information. Thereby, as shown in FIG. 6, the image forming apparatus can shorten the heating time of the heater 201 until the heater 201 reaches the target temperature, and the image forming apparatus can promptly heat the heater 201 to the target temperature more quickly than a conventional image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-176093, filed Sep. 7, 2015 which is hereby incorporated by reference herein in its entirety.

What is claimed is:

1. An image forming apparatus to which a fixing device is detachably mounted, the fixing device comprising a heater, a detector to detect a temperature of the heater, and a first memory that stores information relating to the heater, the image forming apparatus comprising:

a second memory;

an image former configured to form an image on a sheet;

a power circuit configured to supply power to the heater; and a processor configured to control (i) the power circuit based on a power supply condition, and (ii) whether or not to perform update processing that includes reading out the information from the first memory and storing the information in the second memory;

wherein, the power supply condition is one of (i) a first power supply condition that is determined based on the temperature detected by the detector and information previously stored in the second memory, (ii) a predetermined power supply condition, and (iii) a second power supply condition based on the temperature detected by the detector and the information newly stored in the second memory after the update processing, and wherein, (i) in a case in which the power circuit starts supplying the power to the heater and the heater starts heating without performing the update processing by the processor, the processor controls the power circuit based on the first power supply condition, (ii) in a case in which the power circuit supplies the power to the heater and the heater starts heating while the processor performs the update processing, the processor controls the power circuit based on the predetermined power supply condition, and (iii) in a case in which the processor has performed the update processing and has determined the second power supply condition, the processor controls the power circuit based on the second power supply condition.

2. The image forming apparatus according to claim 1, wherein, in a case in which the image forming apparatus is turned ON, the processor performs the update processing.

3. The image forming apparatus according to claim 1, wherein, in a case in which the fixing device is replaced, the processor performs the update processing.

4. The image forming apparatus according to claim 1, wherein the processor performs detection processing to detect replacement of the fixing device.

5. The image forming apparatus according to claim 4, wherein the detection processing is performed based on the information stored in the first memory of the fixing device and information stored in the second memory.

6. The image forming apparatus according to claim 5, wherein the information stored in the second memory includes a serial ID for identifying the fixing device, and wherein the processor detects replacement of the fixing device in a case where a serial ID included in the information stored in the first memory of the fixing device differs from the serial ID stored in the second memory.

7. The image forming apparatus according to claim 1, wherein, the power supply condition is a predetermined power energization pattern.

* * * * *